US008413989B2

(12) United States Patent
Sparago

(10) Patent No.: US 8,413,989 B2
(45) Date of Patent: Apr. 9, 2013

(54) THREE CARD BLACKJACK

(75) Inventor: Merrill Sparago, Los Angeles, CA (US)

(73) Assignee: Score Gaming LLC, Los Angeles, CA (US)

( * ) Notice: Subject to any disclaimer, the term of this patent is extended or adjusted under 35 U.S.C. 154(b) by 0 days.

(21) Appl. No.: 13/297,745

(22) Filed: Nov. 16, 2011

(65) Prior Publication Data

US 2012/0056379 A1 Mar. 8, 2012

Related U.S. Application Data

(63) Continuation-in-part of application No. 12/857,532, filed on Aug. 16, 2010, now abandoned.

(60) Provisional application No. 61/414,070, filed on Nov. 16, 2010, provisional application No. 61/234,077, filed on Aug. 14, 2009.

(51) Int. Cl.
*A63F 1/00* (2006.01)

(52) U.S. Cl.
USPC ..... 273/292; 463/12

(58) Field of Classification Search ..... 463/12, 463/13; 273/292, 274
See application file for complete search history.

(56) References Cited

U.S. PATENT DOCUMENTS

| | | | | |
|---|---|---|---|---|
| 5,743,532 | A | 4/1998 | Lafferty | |
| 5,816,575 | A * | 10/1998 | Keller | 273/292 |
| 5,979,897 | A * | 11/1999 | Grossman | 273/292 |
| 6,113,102 | A | 9/2000 | Marks et al. | |
| 6,158,741 | A | 12/2000 | Koelling | |
| 6,302,396 | B1 | 10/2001 | Eaton et al. | |
| 6,481,718 | B2 | 11/2002 | Koelling | |
| 6,536,767 | B1 | 3/2003 | Keller | |
| 6,729,621 | B2 * | 5/2004 | Moody | 273/292 |
| 6,796,898 | B1 * | 9/2004 | Timpano | 463/12 |
| 6,808,173 | B2 | 10/2004 | Snow | |
| 6,845,981 | B1 | 1/2005 | Ko | |
| 6,874,786 | B2 | 4/2005 | Bruno et al. | |
| 6,877,748 | B1 | 4/2005 | Patroni et al. | |
| 6,896,266 | B1 | 5/2005 | Terminel | |

(Continued)

FOREIGN PATENT DOCUMENTS

| | | |
|---|---|---|
| CA | 2281350 | 3/2001 |
| WO | WO-2005115569 | * 12/2005 |

OTHER PUBLICATIONS

Scanes, "Encylcopedia of Card Games" (c) 1983, Harper Colopone books, pp. 278-289.*

*Primary Examiner* — Arthur O. Hall
*Assistant Examiner* — Nicholas Ditoro
(74) *Attorney, Agent, or Firm* — Endurance Law Group, PLC

(57) ABSTRACT

The invention relates to a modified blackjack game between a dealer and at least one player. After placing initial wagers, three cards are dealt to each player and two cards dealt to the dealer. The game design allows players to either retain their initial three cards for play as a game hand, or divide their cards into separate game hands. Dividing cards into separate hands requires additional wagers. Players may play their one or more game hands by standing or hitting to reach a hand that is higher than the dealers without exceeding twenty-one. Players may divide their initial three card hand in any fashion that will provide them with the best opportunity to obtain a game hand under the conventional rules of blackjack.

6 Claims, 9 Drawing Sheets

U.S. PATENT DOCUMENTS

| | | | | |
|---|---|---|---|---|
| 7,156,734 | B1 * | 1/2007 | Walker et al. | 463/12 |
| 7,175,180 | B2 | 2/2007 | Webb | |
| 7,222,854 | B2 | 5/2007 | Sorge | |
| 7,329,178 | B1 * | 2/2008 | Moore et al. | 463/12 |
| 7,338,362 | B1 | 3/2008 | Gallagher | |
| 7,354,042 | B2 | 4/2008 | Moshal | |
| 7,380,794 | B2 | 6/2008 | Noyes | |
| 7,384,045 | B1 | 6/2008 | David | |
| 7,407,162 | B2 | 8/2008 | Cockrell, Jr. | |
| 7,419,162 | B2 * | 9/2008 | Lancaster et al. | 273/292 |
| 7,419,424 | B2 * | 9/2008 | Gomez | 463/13 |
| 7,431,643 | B2 | 10/2008 | Dargue | |
| 7,451,987 | B1 | 11/2008 | Feola | |
| 7,524,243 | B2 | 4/2009 | Bansemer et al. | |
| 7,549,642 | B2 | 6/2009 | Centrone | |
| 7,562,877 | B1 | 7/2009 | Hess | |
| 2002/0036382 | A1 | 3/2002 | Brunelle | |
| 2003/0164590 | A1 * | 9/2003 | Moody | 273/292 |
| 2004/0124585 | A1 | 7/2004 | Daines | |
| 2004/0195770 | A1 | 10/2004 | Ornstein | |
| 2006/0131809 | A1 | 6/2006 | Lancaster et al. | |
| 2006/0151954 | A1 | 7/2006 | Silverman | |
| 2006/0178184 | A1 * | 8/2006 | Gomez | 463/13 |
| 2006/0192339 | A1 | 8/2006 | Byrne et al. | |
| 2007/0075497 | A1 | 4/2007 | Friedman | |
| 2007/0216098 | A1 | 9/2007 | Santiago | |
| 2007/0228653 | A1 * | 10/2007 | Lambert et al. | 273/292 |
| 2007/0241506 | A1 | 10/2007 | Kling | |
| 2007/0262524 | A1 | 11/2007 | Lambert | |
| 2007/0290444 | A1 | 12/2007 | Moses | |
| 2008/0061506 | A1 | 3/2008 | Byrne et al. | |
| 2008/0064462 | A1 | 3/2008 | Gerrard et al. | |
| 2008/0067744 | A1 | 3/2008 | Heravi | |
| 2008/0067745 | A1 | 3/2008 | Wikstrom | |
| 2008/0067747 | A1 | 3/2008 | Byrne et al. | |
| 2008/0073845 | A1 | 3/2008 | Byrne et al. | |
| 2008/0139268 | A1 | 6/2008 | Zora | |
| 2008/0167104 | A1 | 7/2008 | Moshal | |
| 2008/0191417 | A1 | 8/2008 | Pham | |
| 2008/0230995 | A1 | 9/2008 | Snow | |
| 2008/0237989 | A1 | 10/2008 | Brunelle | |
| 2009/0085296 | A1 | 4/2009 | Webb | |
| 2009/0091082 | A1 | 4/2009 | Mourad | |
| 2009/0102128 | A1 | 4/2009 | Chamberlain | |
| 2009/0134578 | A1 | 5/2009 | Ornstein | |
| 2009/0152815 | A1 * | 6/2009 | Caniano | 273/292 |
| 2009/0256313 | A1 | 10/2009 | Mcgurk et al. | |
| 2010/0178972 | A1 | 7/2010 | Cipiti | |

* cited by examiner

THREE CARD BLACKJACK

CROSS REFERENCE TO RELATED APPLICATIONS

This application claims priority to U.S. Provisional Application No. 61/414,070, filed Nov. 16, 2010 and is a Continuation-In-Part of U.S. patent application Ser. No. 12/857,532, which claims priority to U.S. Provisional Application No. 61/234,077, filed Aug. 14, 2009, the entire disclosures of which are hereby incorporated by reference and relied upon.

BACKGROUND OF THE INVENTION

1. Field of the Invention

The present invention relates to a card game. More specifically, the invention relates to a modified version of the traditional casino card game blackjack or twenty-one.

2. Prior Art

Blackjack or twenty-one is a well-known casino card game. Blackjack is played with one or more standard decks of 52 cards between a dealer and one or more players. The object of the game is for a player to accumulate a hand of cards having a point total exceeding that of the dealer, without exceeding twenty-one. For numbered cards, the point value equals the number value. Face cards (kings, queens, and Jacks) have a point value of ten. Aces are assigned a point value of either one or eleven as determined by the person holding the hand that included one or more aces. A two-card hand having a total point value of twenty-one is known as blackjack.

Blackjack play is commenced by a player making an initial wager ("the ante") on the outcome of his or her upcoming hand. Players typically indicate their bet or wager by placing an appropriate number of chips or markers in a designated area of the blackjack table.

After the wagers have been placed, the dealer deals two cards to each player and two to him or herself. The dealer deals one card at a time to each player and then to the dealer before repeating the process with the second card. Each of the players' cards is dealt face up or face down depending on the number of decks being used. The dealer's initial two cards are typically dealt one face down and the other face up.

After the dealer and the players have been dealt an initial hand of two cards, each player in turn elects to receive additional cards ("hit") or to wait ("stand"). A player may elect to take additional cards until he or she decides to stand or until the total point value of the player's hand exceeds twenty-one, known as "bust." Once all players have either received their desired number of cards or have busted, the dealer turns over the face-down card. Based on the value of that card, the dealer takes additional cards or stands. Under most rules, a dealer must "stand" if the dealer's hand is equal or greater than seventeen and "hit" if the hand is less than seventeen.

Once the dealer has completed the play, the outcome of the game is determined. A player wins if either the dealer busts (dealer's hand exceeds twenty-one) or the player's hand has a greater point value than the dealer's hand. The winning player is paid at 1:1, i.e. receives an amount equal to the initial wager in addition to recovering the initial wager. If the dealer's hand exceeds that of a player's or if a player busts, the wager is lost. If a dealer and the player have equal hands (known as "tie" or "push"), the wager is returned to the player.

During the game, the players have a chance to increase their initial bet ("up the ante"). In addition, a player may split the hand in two hands each hand being supported by two wagers, each of an amount equal to the original wager.

Another option is to "double down", i.e. double the wager in exchange for an additional card.

Blackjack or twenty-one can be modified in various ways to increase the interest of the players. For example, it is often modified by options of various side wagers or side bets. Side wagers are attractive to players because they are perceived as "hedging" the player's chances. For example, a player may bet on a particular outcome of his or her hand. (U.S. Pat. No. 7,222,854). If the outcome is such that the main game is lost but the value of the hand matches the side bet, the player loses the main bet but collects money on the side bet. A similar bet may be placed on the outcome of the dealer's hand (U.S. Pat. Nos. 6,536,767 and 6,113,102). If the dealer receives a winning hand, but the hand also matches the player's side bet, the player loses the main wager but wins the side bet.

In another version of side betting, the players bet on a particular card, such as the next card being dealt. For example, a player may bet that the next card he or she receives will have a particular value (Canadian Application No. 2,281,350). Alternatively, a player may bet on the dealer's face-up card (U.S. Pat. No. 6,796,898) or a dealer's face-down card (U.S. Pat. No. 5,743,532).

In a more exciting variation, the traditional game can be modified by dealing three cards instead of two cards to the players, dealer, or both. For example, in U.S. Patent Application No. 2007/0228653, the players initially place a blackjack wager and a poker wager. The player is dealt three cards and the player uses the three cards to play the poker hand but selects two of the three cards to play the blackjack hand. After the dealer is dealt two cards, one up and one down as in traditional blackjack, the dealer reveals his or her up-card and the poker wager is paid, using a pay table, based on the rank of the player's three initial cards and the dealer's up-card. The blackjack wager is then played according to the traditional rules of blackjack, based on the player's selected two card blackjack hand.

U.S. Patent Application No. 2007/0262524 describes another variation of a three card blackjack game. According to the rules of the game in this patent application, the player places one ante wager and both the player and the dealer are dealt three cards. Both the player and the dealer choose a best hand comprising of two or three cards of the three cards dealt, and the wager is paid if the best player hand beats the best dealer hand. After choosing the best two or three-card hand, the player has a choice to raise if he places a raise wager and can continue the game. If the dealer's hand does not meet qualifying criteria (a total of 17-21) then the player does not win or lose the ante wager, or in an alternative variation, the player wins both the ante wager and raise wager if the player hand beats the dealer's hand and the player loses both the ante wager and raise wager if the dealer hand beats the player hand. If the dealer's hand meets qualifying criteria, then the player wins both the ante wager and raise wager if the player's hand beats the dealer's hand and the player loses both the ante wager and raise wager if the dealer's hand beats the player's hand.

In the conventional game of blackjack, basic strategy is the fundamental guiding principle in playing blackjack and is an essential aspect in directing the player as to deciding whether they hit or stand. As such, players generally follow some form of basic strategy when playing blackjack.

In the conventional game of blackjack, players make a decision to hit (accept more cards) or stand (refuse any further cards) to reach a total as close to, without exceeding twenty-one, and obtaining a hand that has a higher point total than the dealer's hand (i.e. if the player has a hand with a total of twenty and the dealer has a hand with a total of nineteen this would be a win for the player). If the player's hand exceeds twenty-one then this would be considered a "busted" hand and the player would lose their wager. Thus basic strategy encourages players not to "bust" when they have higher odds of winning with the cards they have.

In basic strategy, the player uses the dealer's exposed ("up") card to make their decision as to whether they hit or stand to give them the best chance of beating the dealer.

Basic strategy assumes the dealer's non exposed ("down") card has a value of ten (ten, Jack, Queen, king), as ten value cards are statistically the most common cards in a standard 52 card deck of playing cards. It encourages players to hit and risk "busting" if there is a high probability the dealer's hand has a higher point total than the players, or to stand (not to take cards) and avoid busting if the odds of winning are in the player's favor.

For example, if the dealer's "up" card is a ten value card, players expect the dealer has a total of twenty ("down" card equals ten and "up" card equals ten for a total of twenty). In this scenario, the dealer likely has a very "strong" hand (i.e. closest to, without exceeding twenty-one), and players will take cards so as to potentially beat a total of twenty. Players will risk taking cards and "busting" as they need to reach the desired total.

Alternatively, if the dealer's "up" card is a six value card, the player assumes the dealer has a total of sixteen. As per the conventional rules of blackjack, the dealer must draw more cards with hands that total less than seventeen giving the dealer a high probability of "busting". In this scenario, players will play their hand more conservatively and avoid "busting" in hopes that the dealer will "bust" making the player a winner.

What is needed is an exciting modified blackjack game that combines the familiar aspects of blackjack but with new and entertaining game features that will attract maximum participation of the players, while keeping the odds in favor of the house. The new game should include side wagers because side wagers generally attract players when they are perceived as an extra chance. Just as side wagers attract players, so does having an additional card with several options to proceed based on the initial three cards dealt. It would be especially beneficial to increase the number of wagers made by each player during each round of game play.

SUMMARY OF THE INVENTION

The invention comprises a method for playing a modified blackjack card game between a dealer and at least one player using at least one standard deck of fifty-two cards. A game playing surface is provided, and the dealer and player are positioned on opposite sides of the playing surface. After placing a first wager, three cards are dealt from the deck to the player(s) to form an initial three-card hand. All three cards of the initial three-card hand are arranged face up on the playing surface. The dealer is dealt two cards from the deck to form an initial two-card hand. One card from the initial two-card hand is placed face up on the playing surface and the other card face down on the playing surface. If the total point value of the dealer's initial two card hand is twenty-one, the game may be resolved in favor of the dealer. However, if the point total value of the dealer's initial two-card hand is anything other than twenty-one, the player is invited to choose a game hand. This inviting step includes the option of keeping the initial three-card hand as a single game hand or breaking down the initial three-card hand into multiple distinct game hands. After the inviting step, the player is required to choose between the steps of standing, hitting, doubling down and surrendering each game hand as per the traditional rules of blackjack. Assuming that all player game hands are not a bust, the face down card of the dealer's initial two-card hand is turned to a face up position on the playing surface so that all remaining wagers received from the player can be resolved according to the traditional rules of blackjack.

The subject invention provides a three-card twenty-one game that provides players the added option of playing up to three hands of blackjack per round. The game introduces exciting new concepts and wagering opportunities without departing from the beloved spirit and comfortable rules of traditional blackjack.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE INVENTION

Figure 1:
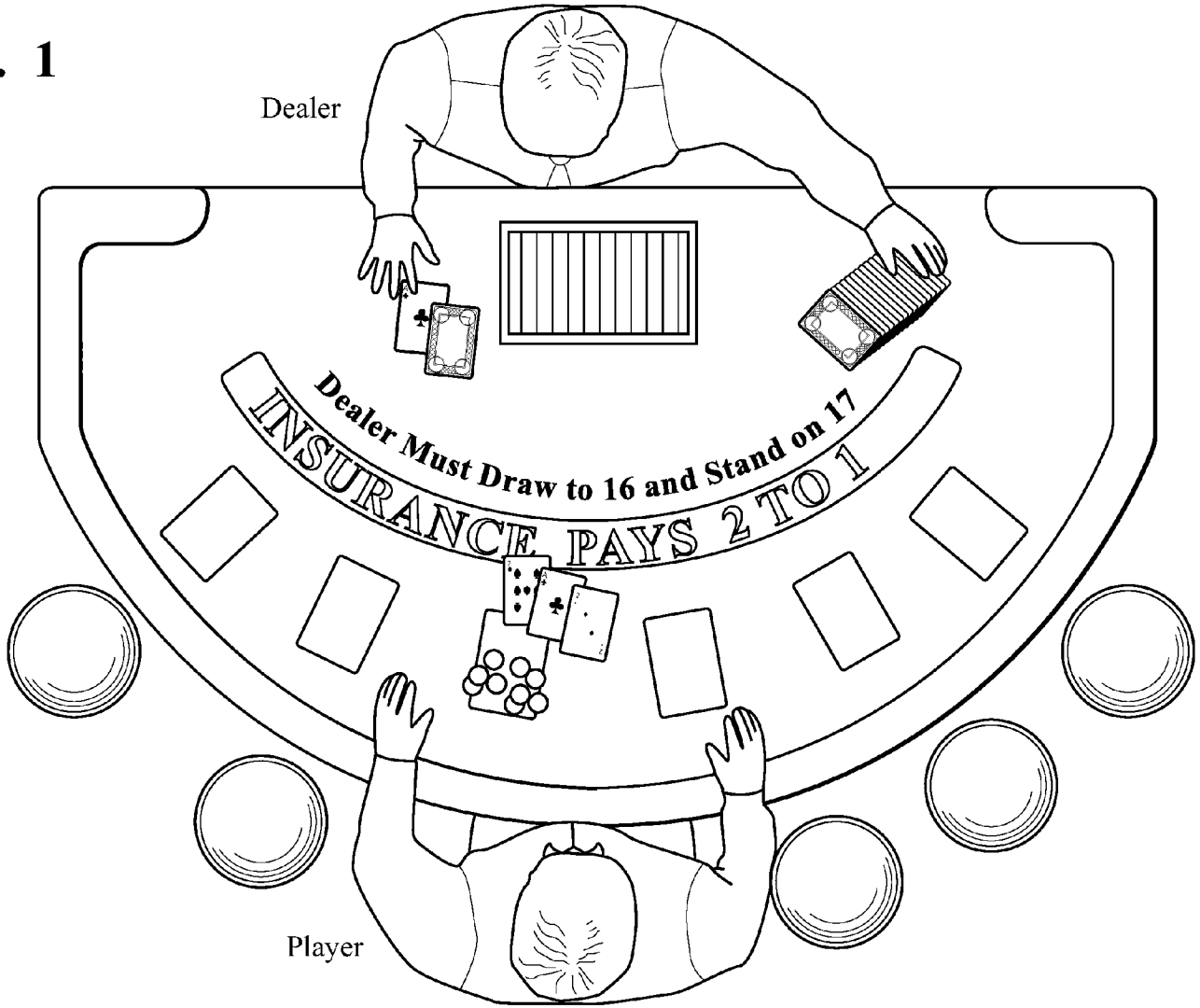
FIG. 1 is an exemplary top view of a game table playing surface with dealer and player stationed on opposite sides according to one exemplary embodiment of the invention.

The invention is a three-card blackjack game in which multiple wagers and side bets may be placed. The method of playing the modified blackjack game is between a dealer and at least one player using at least one standard deck of 52 playing cards. A standard deck of playing cards is composed of 52 cards and 2 jokers resulting in a total of 54 cards. In the traditional game of blackjack, as well as the present modified game of blackjack described below, the 2 jokers are removed and not used in the play of the game leaving 52 cards in the deck. Excluding the jokers, a standard card deck has 13 differently ranked cards, each card in 4 suits (diamonds, hearts, clubs and spades). Cards range in value from 2 through 10's, then Jack, Queen, King, and finally an Ace. Thirteen individual cards in four suits give a total of 52 cards. Preferably, the game is played with six standard 52-card decks of playing cards, shuffled together before play from a shoe, although other deck multiples are certainly possible.

A first card is dealt to each player face up and a first card is dealt to the dealer face down. A second card is dealt to each player face up, and to the dealer face down, and a third card is dealt to each player only, face up. The dealer then reveals their second card by turning over the face down card. Dealing may be by hand, from a shoe, or by virtual/computerized manifestation via a suitably configured computer provided with a non-transitory computer readable medium coded with instructions and executed by a micro-processor.

Alternatively, players may receive all three cards at once (either face up or face down), beginning with the player on the dealer's immediate left. Each subsequent player is then dealt their three cards until all players have received their cards. The dealer then takes two cards both face down and exposes one card and places that on the unexposed card. Alternatively, the dealer may also take three cards face down and burn the first of the three cards, leaving two cards face down. The dealer then exposes one of the two cards and places that on the unexposed card.

Hands are scored as in traditional blackjack, with aces counting as either one or eleven, face cards counting as ten, and all other cards counting as their pip total. The present modified blackjack game has several specific strategies based on the variety of options available to obtain winning hands. Players can win with point totals that approach but do not exceed twenty-one, and have a higher value than the dealer's point total. Alternatively, players can strive for a point total of thirty, and gives the player an automatic win regardless of the point total of the dealer's hand (i.e., player has thirty and the dealer has twenty is a win for the player).

The game design allows players to either retain their initial three cards and play to twenty-one, or divide their cards into two or three separate hands. Dividing cards into separate hands requires additional wagers two and three.

In the modified blackjack game, the player receives an initial three cards. However, the dealer only initially receives two cards (in an alternative embodiment described below, the dealer may receive a third card) as in the conventional game of blackjack. This feature preserves the basic strategy of blackjack as described above, directing players in their decisions.

Alternatively, players can try to reach a total of thirty or various other pre-configured winning card combinations considered an automatic win for the player (i.e. the player does not have to beat the dealer as the dealer only plays to a maximum of twenty-one). Thus, players may play against the dealer (in striving to beat the dealer while not exceeding twenty-one) or play against a pay table based on the components of their hand reaching a pre-established combination or pre-specified point total.

Figure 2:
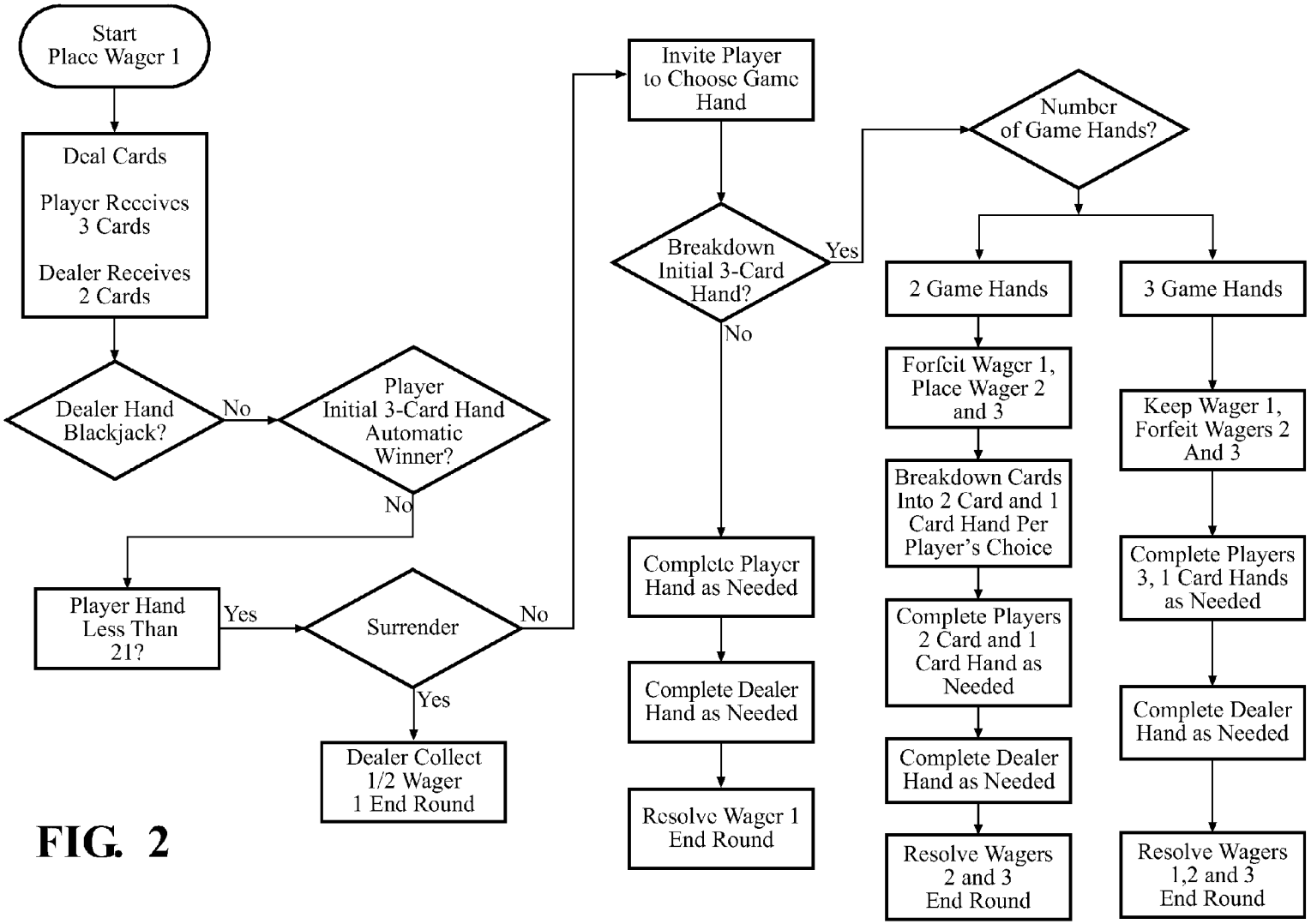
FIG. 2 is a flow chart depicting a method of game play according to one embodiment of this invention.

Turning now to FIG. 1, a simplified depiction of a player and dealer stationed on opposite sides of a game playing surface is shown for illustrative purposes. As will be readily understood by those of skill in the art, the game methods of this invention, like traditional blackjack, can be played simultaneously with multiple players against a single dealer. FIG. 2 is an exemplary flow chart depicting a round of play according to the principles of this invention. Each round of play begins with each player making a mandatory wager, referred to throughout the figures as Wager 1. Each player in play is dealt three cards, face up. This constitutes an initial three-card hand for each player. The dealer is dealt two cards, one card face up and the other card face down. This constitutes the dealer's initial hand. Any player who is dealt a three card total of twenty-one automatically wins. The house or casino may optionally establish an initial three-card pay table having a plurality of predetermined three-card combinations with associated payout rates. If the player's initial three-card hand matches one of the predetermined three-card combinations in the three-card pay table, they may also be declared an automatic winner and paid a predetermined factor based on their Wager 1 amount. For example, two suggested pay tables are shown below in the form of predetermined three-card combinations which may be paid to a player based on their initial three card hand:

| Hand | Pay Table A | Pay Table B |
|---|---|---|
| Q-Q-J or Q-Q-K | 50:1 | 50:1 |
| J-J-Q, J-Q-K, K-K-Q | 10:1 | 10:1 |
| Any other "30" | 3:2 | 3:2 |
| 7-7-7 | 15:1 | 15:1 |
| Straight Flush | 10:1 | 10:1 |
| Straight | 3:1 | 2:1 |
| Ace + two 10 value cards | 3:2 | 2:1 |
| Flush | 2:1 | 1:1 |
| Other totals of 21 | 1:1 | 1:1 |

Once all players with automatic winners have been paid, if the dealer has an ace or ten showing he will then check his own hand for a natural blackjack. Insurance may be offered to the players at this time when an Ace is showing as per the traditional rules of blackjack. If the dealer has a natural blackjack, the house automatically wins and all remaining players (i.e., those which did not achieve automatic winning status as described above) lose their Wager 1. However, any players who took insurance bets may be paid off at a rate of 2:1.

If the dealer does not have a natural blackjack, he or she will then collect any insurance wagers and then invite each player in turn to make one of the following choices with respect to their hand: 1) keep their initial three-card hand as a single game hand, or 2) break down the initial three-card hand into multiple distinct game hands. For a player to keep their three-card hand, they simply choose to play the hand as is. If the player makes this choice, in addition to standing or hitting as per normal blackjack, they may also double down on their hand and thereby receive one more card. Further, the player may choose to surrender their hand and lose one half of the value of Wager 1, as per the traditional rules of blackjack. A player who has a card sum above twenty-one in their initial three-card hand and does not wish to break down their hand may surrender instead of simply losing a busted total.

When choosing to break down their three-card hand, the normal option is to divide the hand into a two-card hand and a one-card hand. Wager 1 is forfeited and the player is required to place two additional wagers, referred to herein as Wager 2 and Wager 3.

However, in certain variations of play, initial three card hands that reach a pre-determined total such as 28-30 (whether hard or soft i.e. containing an Ace which is ascribed a value of 11) may be broken down into a two-card hand and a one-card hand without forfeiting Wager 1. Wager 1 remains in play and the player must only make Wager 2, therefore there can be instances where the player does not forfeit Wager 1 when breaking the three cards down into a two-card hand and a one-card hand.

Thereafter, with respect to each game hand, the player may stand, hit, or double down as per the traditional rules of blackjack. If the player's initial three-card hand contained a pair, the player may break down the initial three card hand into three one-card game hands. In this scenario, one card from the initial three-card hand goes into each of the three game hands. The player keeps Wager 1 and is required to place Wagers 2 and 3 under this option, and thereafter receive additional cards for each respective hand from the dealer, from which the player may decide to stand, hit or double down as per the traditional rules of blackjack.

Figure 3:
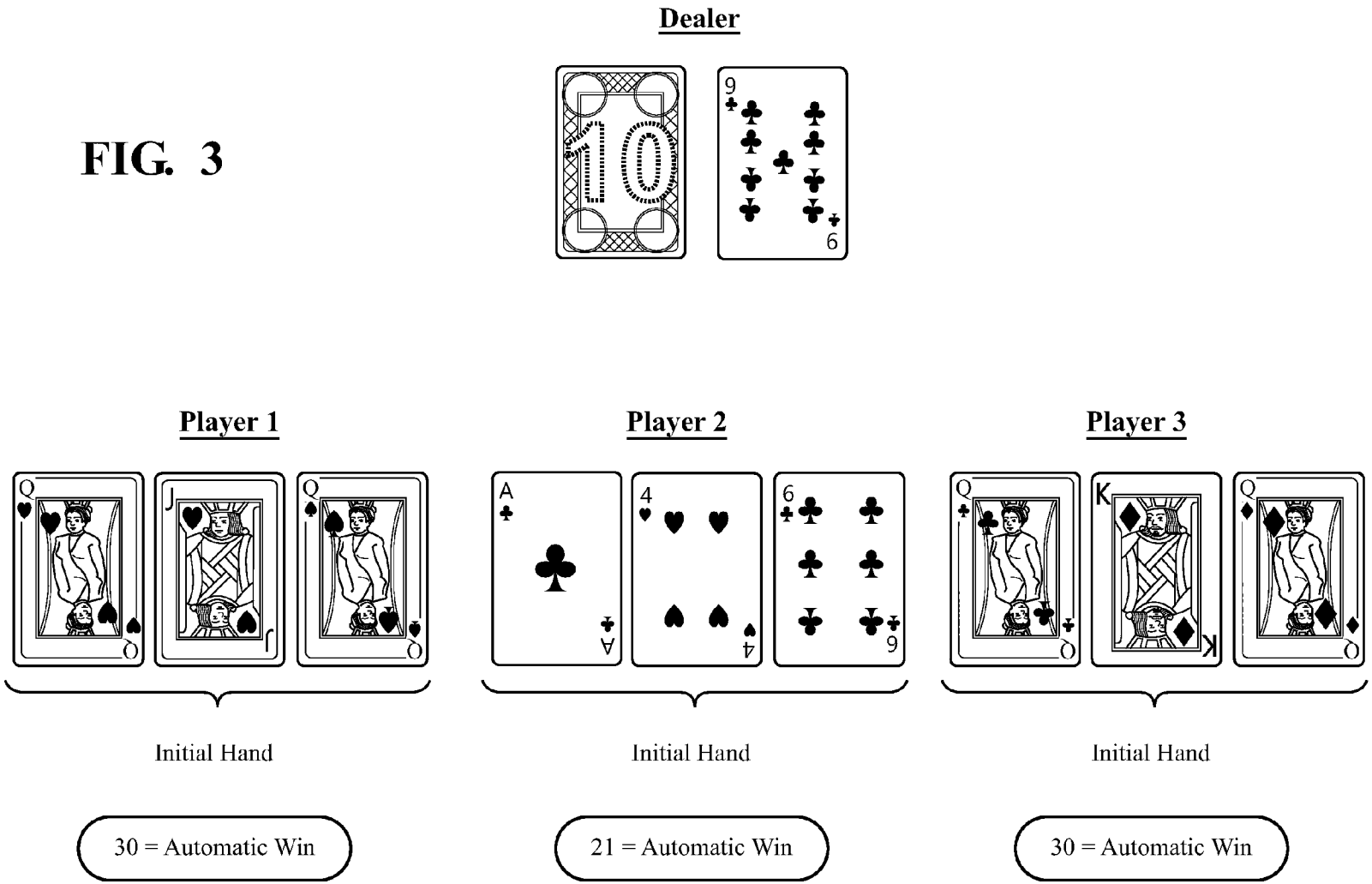
FIG. 3 is a simplified depiction of a card game according to this invention wherein three players have been dealt initial hands of three cards each, and each initial hand constitutes an automatic win.

FIG. 3 provides an exemplary illustration wherein a dealer's initial two-card hand is not a natural blackjack. Player 1 automatically wins because their initial hand contains two Queens and a Jack which is identified as a predetermined card sum in the exemplary Pay Table. Player 2 automatically wins because the sum of all three cards in their initial hand equals twenty-one. Player 3 is also an automatic winner because their initial three-card hand contains the combination Queen-Queen-King which is identified as a predetermined winning combination.

Figure 4:
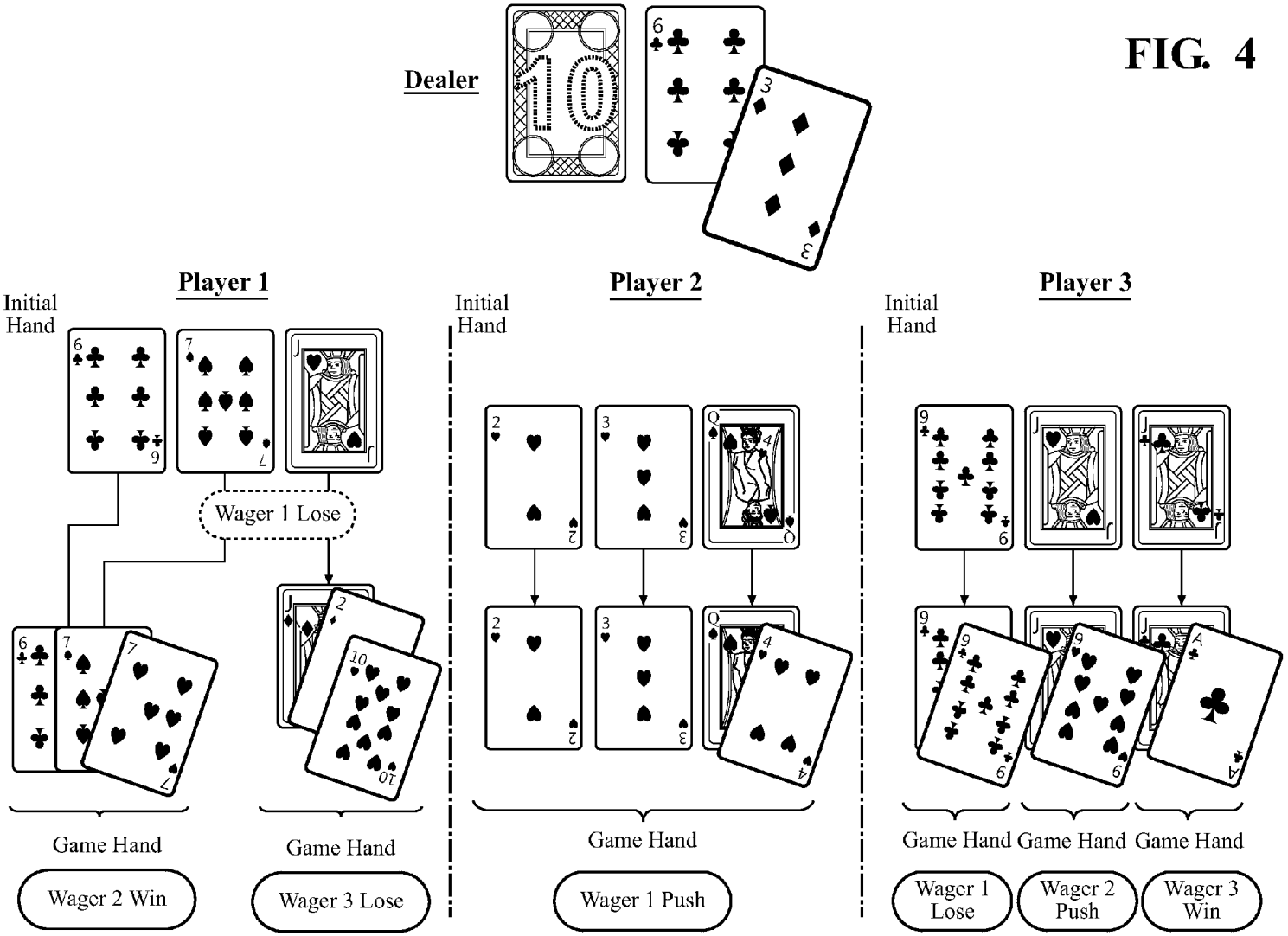
FIG. 4 is a simplified view of a playing surface wherein three players each receive a three card initial hand and illustrating principles of game play according to a preferred embodiment of the invention.

FIG. 4 illustrates an exemplary game play where the dealer does not have a natural blackjack and none of the three players have an automatic winning initial hand. When Player 1 is invited to choose a game hand, they decide to break down their initial three-card hand into two distinct game hands. The six and seven cards are placed in one game hand and the jack card is placed in a second game hand. Player 1 forfeits Wager 1 in order to pursue this option. Player 1 hits to the six-seven game hand and receives a seven card for a total of twenty. Player 1 stands with respect to this game hand and then turns attention to their other game hand. The first card dealt on the jack is a two and the player indicates another hit whereupon they are dealt a ten card. With a card sum total of twenty-two, the player busts and thereby loses Wager 3. The resolution of Wager 2 will be deferred until the dealer's hand is completed. When Player 2 is invited to make a decision with regard to their game hand, they decide to keep their initial three-card hand as a single game hand. The sum total of their cards is fifteen and Player 2 indicates a hit, whereupon they are dealt a four card. The sum total of Player 2's cards in their game hand is nineteen and player two decides to stand. Resolution of Player 2's hand is deferred. Player 3 is then invited to choose a game hand. Because Player 3 has a pair of Jacks, Player 3 decides to break down their initial three-card hand into three distinct game hands. The dealer deals one additional card to each game hand. The first game hand results in a nine-nine or sum total of eighteen which Player 3 stands on. The next Jack receives a nine card for a game total of nineteen which Player 3 stands on as well. The third Jack receives an ace thereby resulting in a natural blackjack and winning Wager 3. Thus, with all three players hands played to completion, the dealer reveals their face down card to be a ten and thus a total of sixteen. House rules require the dealer to take another card which is a three resulting in a dealer hand total of nineteen whereupon the dealer stands. In resolving wagers, Player 1's remaining game hand wins as having a higher value than the dealer's hand. Player 2's game hand is a push as having an equal value with the dealer's hand. Player 3's first game hand loses as having a lower value than the dealer's hand, however their second hand is a push as having an equal value to the dealer's hand. Thus, all players hands are resolved according to the methods of this invention.

In another variation of the modified blackjack game, the player places a single wager and starts with three cards. The dealer starts with two cards. In contrast to previous embodiments where the player could only break down their initial three card hand into three one card hands if their original three card hand contained a pair, this embodiment allows the player to breakdown their hand into three one card hands if 1) the player has a pair in their original three card hand, or 2) the total of the players first three cards does not exceed twenty-one. Wagering will be identical to the play of three one card hands when the player received a pair. That is, to play three one card hands the player will keep the initial wager and place two other wagers, for a total of three active wagers, with each wager representing the play of each individual one card hand.

For example, if a player's first three cards were a King, a four, and a three, in addition to hitting, standing, or breaking down into a two card and one card hand, the player may also divide the cards into three one card hands by placing wagers two and three. All hands will be played as per the traditional rules of blackjack. Bonus wagers can also be incorporated as per previous embodiments.

In a last embodiment, the player places a single wager and starts with three cards. The dealer starts with two cards. In contrast to previous embodiments where the player could only win a bonus on the initial three card wager if their hand had a total of 21, 31, or 32, this embodiment allows players to be paid a bonus (recommended 3:2 as per traditional blackjack) if their first two out of three cards comprise a blackjack (that is any ten valued card and an Ace). The third card will still be dealt as the player can still reach a total of 31 or 32 and qualify for the respective bonuses associated with those totals.

In an alternate version of the modified game, (henceforth referred to as the "modified game"), players also start with 3 cards. Additionally, the modified blackjack game will provide for a method for the player to utilize a single main wager to win bonuses based on hybrids of poker and blackjack hands. Thus, the same single wager can still be used to play the main modified game even if the player was unable to achieve a bonus payout from the initial hybrid wager.

The modified game will be played with a variant of a standard 52 card deck (which by definition excludes jokers). In contrast, to the methods described previously where game play requires uses all 52 cards, all aces will be taken out of the standard 52 card deck (henceforth referred to as the "modified deck"), leaving a total of 48 cards in the play of the modified game. Jokers are not part of the modified deck and are not used to play the modified game. The modified game can be played with a single or multiple modified decks as determined by the house. Further, the dealer starts with three cards (i.e. the same number of cards as the player). The cards will be dealt in groups of three. All cards will have the same rankings as per the standard game of blackjack. The modified game can be played with a single or multiple (e.g., 2 or more) modified decks depending on house rules.

As opposed to the method described previously where players and the dealer strive to reach, but not exceed, a total of 21, the goal of the current version of the modified game will be for players and the dealer to try and reach, but not exceed, a total of 30. Totals of 30 will be considered the highest hand in the modified game. Card totals that exceed 30 will be considered busts and will be automatic loses for players. This is analogous to the principles of standard blackjack where hand totals that exceed a maximum total (for blackjack this total is 21) are considered busts and automatic loses.

Like in blackjack, the current version of the modified game has a highest hand which beats all other hands. Accordingly, if the player's original three card hand is comprised of three 10 valued cards by standard blackjack rankings (i.e. ten, Jack, Queen, King) for a total of 30, this would be considered an automatic win for the player. The current version of the modified game allows for multiple levels of bonuses based on the various card combinations that a player can receive which reach a total of 30.

Hands that total thirty which consist of more than three cards formed by the player or dealer hitting hands less than 30, will also be paid automatically. Thus if a player were dealt an original 3 card hand of 5,5, and 10 for a total of 20 and decided to hit and received a Jack for a total of 30, this would be an automatic win for the player, independent of the composition of the dealer's hand.

In the modified game, the players and the dealer are each dealt 3 cards from the modified deck. Dealing may be by hand, from a shoe, or by virtual/computerized manifestation via a suitably configured computer provided with a non-transitory computer readable medium coded with instructions and executed by a micro-processor. The cards are dealt in groups of 3, either manually, or from an automated dealing machine, or in virtual format.

A round of the modified game requires at least a single player and a live or virtual dealer. To start the game, a player/players places a single "ante" wager in a designated spot on the modified game's playing surface. The player is then dealt 3 cards face up or down as per individual house rules. In contrast to standard blackjack and variations described previously where each player and then the dealer are dealt one card at a time until all players and the dealer receive their 2 starting cards, players and the dealer will be dealt their 3 cards at the same time in the modified game.

Like the player, the dealer is also dealt 3 cards face down. The dealer always receives their cards last (i.e. after all after players receive their cards). After the dealer receives their three cards, the dealer exposes 2 of the three cards, leaving one card unexposed. This is analogous to variations described previously and standard blackjack where the dealer also has a single unexposed card. However, in this version of the modified game the dealer will be exposing 2 cards.

In the event there are multiple players at the table, dealing will begin with the player on the dealer's immediate left and move in a clockwise fashion until all players and then the dealer receive their cards. This would be similar to the method of dealing cards in standard blackjack. Naturally, the dealing procedure may be altered as per casino/house rules.

An object of this version of the modified game is for the player and the dealer to use their original cards, and, if needed, subsequently dealt cards obtained by hitting, to form a hand with a total closest to, without exceeding, 30. Further, the player's object is to have a final hand with a total that is 30 or less and is of higher value than the dealer's total. If the player's final hand meets these requirements, the player will win their wager. As in methods described previously, hand totals will be calculated using the standard blackjack rankings of the cards After the dealer distributes all cards to each player and then themselves as per the method described above, play will begin with the player on the dealer's immediate left. After this player completes their hand, play will then move in a clockwise direction until all players have completed the play of their hands. Play will then move to the dealer.

When the player receives their initial 3 cards, they will sum the values of each individual card together to form a total. At this point the player will have several options in the play of their hand with the goal of forming a hand with a total closest to, without exceeding, 30 using standard blackjack rankings. As in standard blackjack players will have several options to play their hands. The options will include all options available in standard blackjack as well as additional options described in previous versions of the modified game shown described previously.

Accordingly, the player may hit, stand, double down, or surrender as per the procedures and rules of standard blackjack and variations described previously. Additionally they may divide their cards into three one card hands (i.e. a "three way") and play three hands against the dealer, or "breakdown" their original 3 hands into a 2 card and 1 card hand and play 2 hands against the dealer as in the method above.

As such, standing if a player is a dealt an initial 3 card hand of Queen, 10, and 9, they have a total of 29. This would be considered a strong hand in the modified game as only a dealer hand of 30 can beat the player. In this the case, the player's best option is to stand and not taking any additional cards. The player will signal to the dealer by verbal or hand gesture they would like to stand. After a player stands play then moves to the next player/and or dealer as indicated.

Players hit when they are not satisfied with the total represented by the cards in their hand. Players will hit by requesting another card to be added to their hand as they try to reach a total closest to without exceeding 30. The player may hit as many times as they would like as long as the total of their hand does not exceed 30. They will stand when they reach their desired total. If the total of the player's hand exceeds thirty after hitting this is considered a bust and their hand is completed.

In traditional blackjack, and in methods described previously, player's can double their initial wager to receive one card only in hopes this card will lead them to a total that beats the dealer. This process is called "doubling down". If the player beats the dealer after doubling down then the player wins 1:1 on both wagers.

Doubling Down will also be an option available to players in the current version of the modified game with the following changes: 1) The player will only be able to double down on the first 3 cards that comprise their original hand; and 2) Player's will not be able to double down on 3 card hand totals that result from splitting or breaking down hands, unless house rules allow. (In general, players will not be allowed to double down on hands consisting of only 2 cards, unless house rules dictate otherwise). Otherwise, the method of placing a double down wager, playing, and resolving said wager will be identical to the traditional rules of blackjack.

In traditional blackjack, if the player does not want to play their original 2 card hand, they may have the option to "surrender". Surrendering is available in some blackjack games as per individual house rules. The method of surrendering in this version of the modified game will be the same as those described above for other versions. When their turn comes, the player can signal by hand gesture or verbal cue that they would like to surrender their hand. The dealer will then clear the player's original 3 cards and collect ½ or 50% of the player's original wager. This will end the round for the player.

In certain instances, the player and/or the dealer may hit and receive a card that puts total sum of their cards exceeds a total of 30. This is a bust. Players will complete the play of their hands before the dealer. If the total value of player's hand is greater than 30, this is considered a bust and an automatic loss for the player. If the player busts, the dealer will remove their cards and their original wager. After all players complete play of their hand the dealer will then play. If the dealer busts, all players that did not previously surrender or bust will win their unresolved wager(s).

The procedure of breaking down a hand is analogous to the methods described above in prior variations. When a player breaks down a hand, they divide their initial 3 cards into a two card hand and a 1 card hand. The method specifies that the player forfeits their original wager and must then place 2 new wagers of equal value to the original wager to break down their original 3 card hand. The player chooses which cards go in the 2 card hand, and which card goes in the 1 card hand. Depending on house rules, the player may move the cards themselves, or the dealer will move the cards as per the player's preference. Play then begins from the 2 card hand to the 1 card hand following the rules of blackjack including hitting, standing, doubling down, or splitting certain pairs.

As per the method described above for prior variations, players may divide their original 3 card hand into 3 one card hands if their original three cards contain a pair. A pair refers to cards that are an exact match. Cards that have an equal point value by standard blackjack rankings are not a pair unless they are an exact match. Thus, a ten and a Jack are not a pair as they are not an exact match even though they both have a point value of 10. In contrast a Jack and a Jack, or a ten and a ten would be pairs.

To play 3 one card hands (a "three-way"), the player must place 2 wagers equal to the initial wager. As opposed to breaking down a hand, players do not lose their initial wager when playing a three-way. After the player divides their cards play of the three-way will be exactly as per the method described above, except 1) Players will automatically given 2 cards to add to their one card hand, and 2) players will not be able to double down or split hands after the player divides their cards into 3 one card hands, and 3) players will be trying to reach a goal of 30 as per the rules of the current version of the modified game. Doubling on 3 card hands may be allowed as per house rules.

This version of the modified game may also include bonus hands, whereby players will receive additional monies if their initial 3 card hand that meets predetermined criteria. Again, unique to the current invention, the original wager can be used to pay bonuses with blackjack hands, poker hands, and hybrids of blackjack and poker hands in the absence of a side wager (note a side wager can be added to the modified game). Further if the player does not win the bonus they can still play on to win the main game. Players who qualify for the bonus on the main wager will win automatically irrespective of the composition of the dealer's hand. Therefore: 1) A player will not lose any money if they do not qualify for a bonus on their first 3 cards; and 2) A player will win a bonus on a main wager that is independent of the dealer's hand. This is in distinction to other games where main wagers and bonus wagers are separated whereby, 1) The player needs to make an additional wager to qualify for bonuses; 2) If the player does not get a bonus they will lose the bonus wager; and 3) The outcome of the main wager is dependent on the outcome of the dealer's hand, whereby a player can lose a bonus hand if the dealer has a hand of equal value.

Accordingly, players in the modified game will automatically win their main wager at a suggested ratio of: 1) 1:1 if the total of their first 3 cards equals thirty (i.e. three 10 valued cards); 2) 3:1 if the total of their first 3 cards equals thirty, whereby 2 of the cards are queens and 1 of the cards is a King; 3) 3:1 if the total of their first 3 cards equals thirty, whereby 2 of the cards are queens and 1 of the cards is a Jack. Further bonuses can be paid for hands that meet the above criteria where all of the cards are the same suit The following exemplary pay table illustrates the payout for bonuses on the main wager for the players first 3 cards in the modified game:

| PLAYER FIRST 3 CARDS | BONUS PAYOUT | EXAMPLE ON $5 WAGER |
|---|---|---|
| ANY 30 (3 TEN VALUED CARDS OTHER THAN Q, Q, K OR Q, Q, J) | AUTOMATIC WIN 1:1 | WIN $5 INDEPENDENT OF DEALER'S HAND |
| QUEEN, QUEEN, KING (Q, Q, K) | AUTOMATIC WIN 3:1 | WIN $15 INDEPENDENT OF DEALER'S HAND |
| QUEEN, QUEEN, KING (Q, Q, J) | AUTOMATIC WIN 3:1 | WIN $15 INDEPENDENT OF DEALER'S HAND |

After all players complete play of their hand, and busted hands and their respective wagers are cleared the dealer play will their hand. The dealer will: 1) Reveal the 1 unexposed card so there are now 3 exposed dealer cards; 2) Sum the total of their 3 cards; 3) Stand, if the total of the dealer's first 3 cards is 25 or greater; 4) Hit if the total of the dealer's first 3 cards is 24 or less until the total is 25 or greater; and 5) Stop taking cards if the total of their hand exceeds 30 (i.e. bust).

As in standard blackjack, and methods described above for previous variations, the method to determine if the player has won, lost, or pushed their wager, will be based on the dealer comparing the strength of their final hand against the relative strength of the player's final hand, provided the player's first 3 cards did not qualify for an automatic bonus. Additionally, players who busted will have automatically lost their wager prior to the dealer playing their hand, thus their wagers have been resolved.

If the player receives a hand whereby their first 3 cards totals 30 (i.e. three 10 valued cards), the player will be paid when play comes to that player, and the dealer will remove their cards. Thus players who have been dealt a bonus hand will be paid, and their cards are collected before the dealer plays their hand.

After the dealer completes their hand as described by the method above (i.e. hit on all totals of 24 or less, and stand on all totals of 25-30), and their hand is: 1) Higher than the total of the player's hand (that has not exceeded 30) the player will lose their wager; 2) Lower than the total of the player's hand (that has not exceeded 30) the player will win their wager at a ratio of 1:1; and 3) Equal to the total of the player's hand (that has not exceeded 30) the player will push their wager (i.e. the original wager will be given back to the player).

This can be demonstrated in the following table:

| PLAYER'S FINAL HAND | DEALER'S FINAL HAND | OUTCOME | EXAMPLE ON $5 WAGER |
|---|---|---|---|
| HIGHER THAN DEALER'S FINAL HAND WITHOUT EXCEEDING 30 | LOWER THAN PLAYER'S FINAL HAND WITHOUT EXCEEDING 30 | PLAYER WIN | WIN $5 |
| LOWER THAN DEALER'S FINAL HAND WITHOUT EXCEEDING 30 | HIGHER THAN PLAYER'S FINAL HAND WITHOUT EXCEEDING 30 | PLAYER LOSS | LOSE $5 |
| EQUAL TO DEALER'S FINAL HAND WITHOUT EXCEEDING 30 | EQUAL TO PLAYER'S FINAL HAND WITHOUT EXCEEDING 30 | PLAYER PUSH | $5 WAGER RETURNED TO PLAYER |
| PLAYER HAND GREATER THAN 30 (BUST) | NOT APPLICABLE | PLAYER LOSS | LOSE $5 |

-continued

| PLAYER'S FINAL HAND | DEALER'S FINAL HAND | OUTCOME | EXAMPLE ON $5 WAGER |
|---|---|---|---|
| PLAYER HAND LESS THAN 30 | DEALER PLAYER HAND GREATER THAN 30 | PLAYER WIN | WIN $5 |

After the dealer has resolved all player's wagers, play will begin again for all player's who place a new main wager to play the modified games.

The current version of the modified game also allows for side wagers to be played in addition to the main wager. Side wagers can be constructed on similar principles as described in prior versions of the modified game by defining criteria that the player's first three cards must reach in order to trigger a bonus payout. An example would be paying the Queen, Queen, King, or Queen, Queen Jack a larger payout. Similarly hands that are 3 identical cards or meet criteria for other well established poker hands such as straights, flushes, and straight flushes can be added to the pay table on the side wager.

As per previous versions of the modified game bonuses could be also added to the side wager allows the player to use the side wager strategically in order to offset possible losses on the main wager. This again incorporates novel strategy in the play of the wager and the side wager.

For example, hands that are likely to bust are called "stiff" hands in blackjack. A stiff would include the player's first 2 cards consisting of a total point value of 12-16. Since 12-16 is not generally a winning total unless the dealer busts, players often take a hit on these hands, however all hands 12-16 can exceed 21 with the addition of 1 card. Thus if a player hits a stiff hand, they always have the possibility of busting. When a player hits a non stiff hand 2-11, they can never bust by taking 1 additional card.

In the current version of the modified game, player's whose first 3 cards total 21-25 are stiff hands as all of these hands are generally losing hands for the player if they stand, but can also bust with the addition of a single card after hitting. Placing these stiff hands as possible wins in the side wager, allows the player to strategically place a fraction of their main wager on the side wager so they still win if they have a stiff hand and lose or bust after hitting a stiff hand. By playing a fraction of the main wager, the player would still win money on their main wager if they were not dealt a stiff hand but won the main wager.

For example, if the player were to bet equal amounts on the main and side wagers and the player were dealt any hand other than those which total 21-25, they would lose their side wager. If the won their main wager the net outcome of their play would result in 1 loss and 1 win of equal amounts or no net gain. Thus if a player placed $5 on the main wager and $5 on the side wager, and won the main wager and lost the side wager (i.e. were not dealt a stiff or any other three card hand that qualified for a win on the side wager) they would net profit $0 ($5 win−$5 loss=$0 win).

However, if the player adopted a betting strategy where they placed more money on the main wager than the side wager they would still come out ahead in the scenario above. Thus if a player placed $5 on the main wager and $1 on the side wager, and won the main wager and lost the side wager (i.e. were not dealt a stiff or any other three card hand that qualified for a win on the side wager) they would profit $4 ($5 win−$1 loss=$4 win). Each player can then develop their own unique betting system with a full main wager and a fractional side wager giving them the highest likelihood of achieving a net win.

Further, players may change their strategy for play on the main wager based on the fraction of the main wager they placed on the side wager. For example, if the side wager paid for stiffs and the player were dealt a 24 they would have won money on the side wager. The player may then choose to be: 1) More aggressive in the play of the main wager (i.e. hit) and risk busting as they already have made some money and the risk of busting comes with a lower risk of a net loss; or 2) More passive in the play of the main wager (i.e. stand) and not risk busting as they already have made some money and the risk of the dealer making a hand that beats the player's hand also comes with a lower risk of a net loss.

Figure 5:
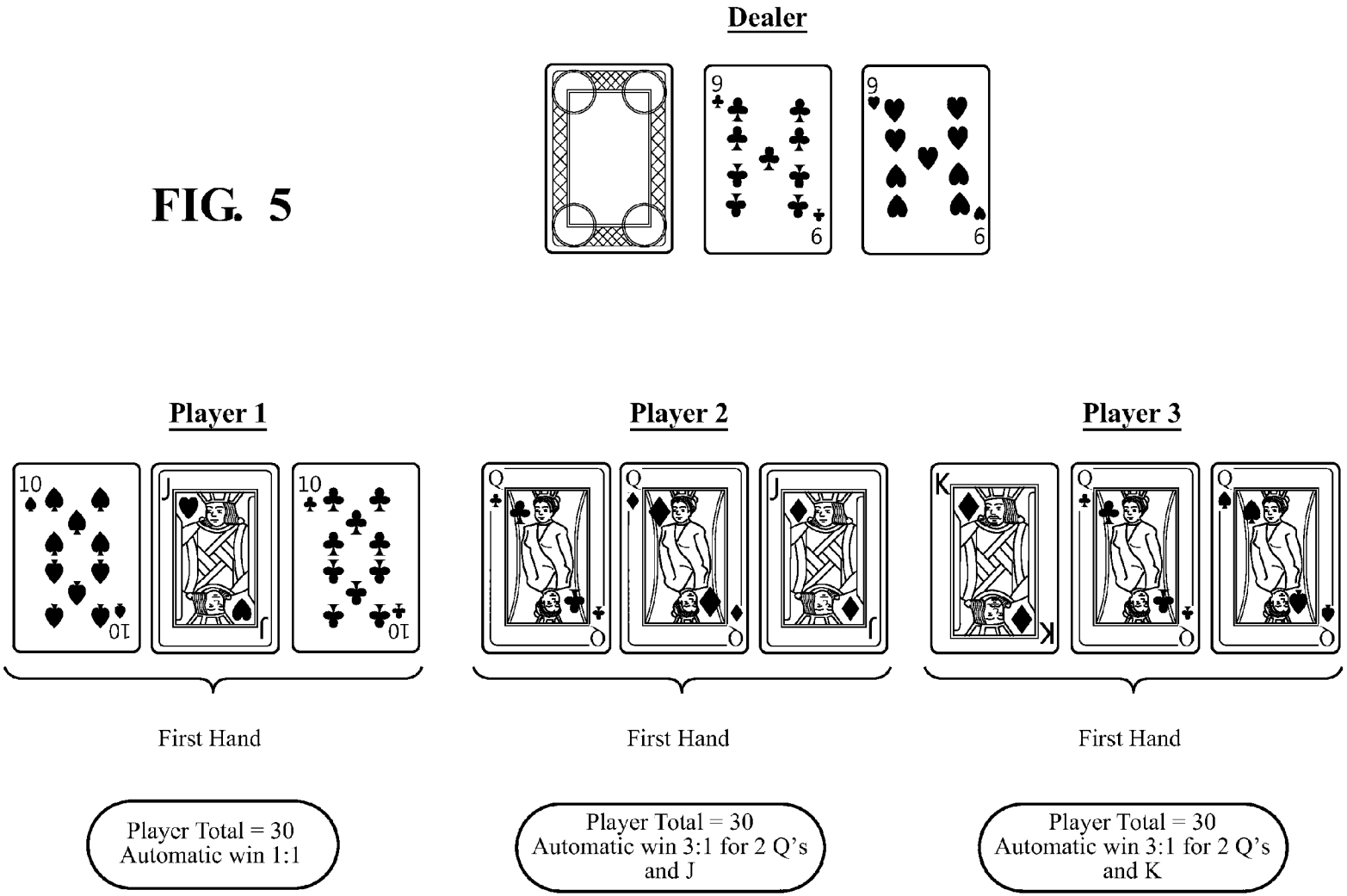
FIG. 5 is a simplified view of a game playing surface according to a modified implementation of the subject game wherein both dealer and player receive an initial hand of three cards each.

FIG. 5 is an exemplary depiction of a round of the version of the modified game where both dealer and player start with 3 cards and try to reach, without exceeding, a total of 30. In this example the players each have a 3 card hand total of 30 and automatically win. Player 1 has a 3 card total of 30 and is paid 1:1. Players 2 and 3 have a three card total of 30 but in a bonus arrangement of Queen, Queen, Jack; and Queen, Queen King respectively. Both player 2 and 3 are paid a bonus of 3:1 on their initial wager.

Figure 6A:
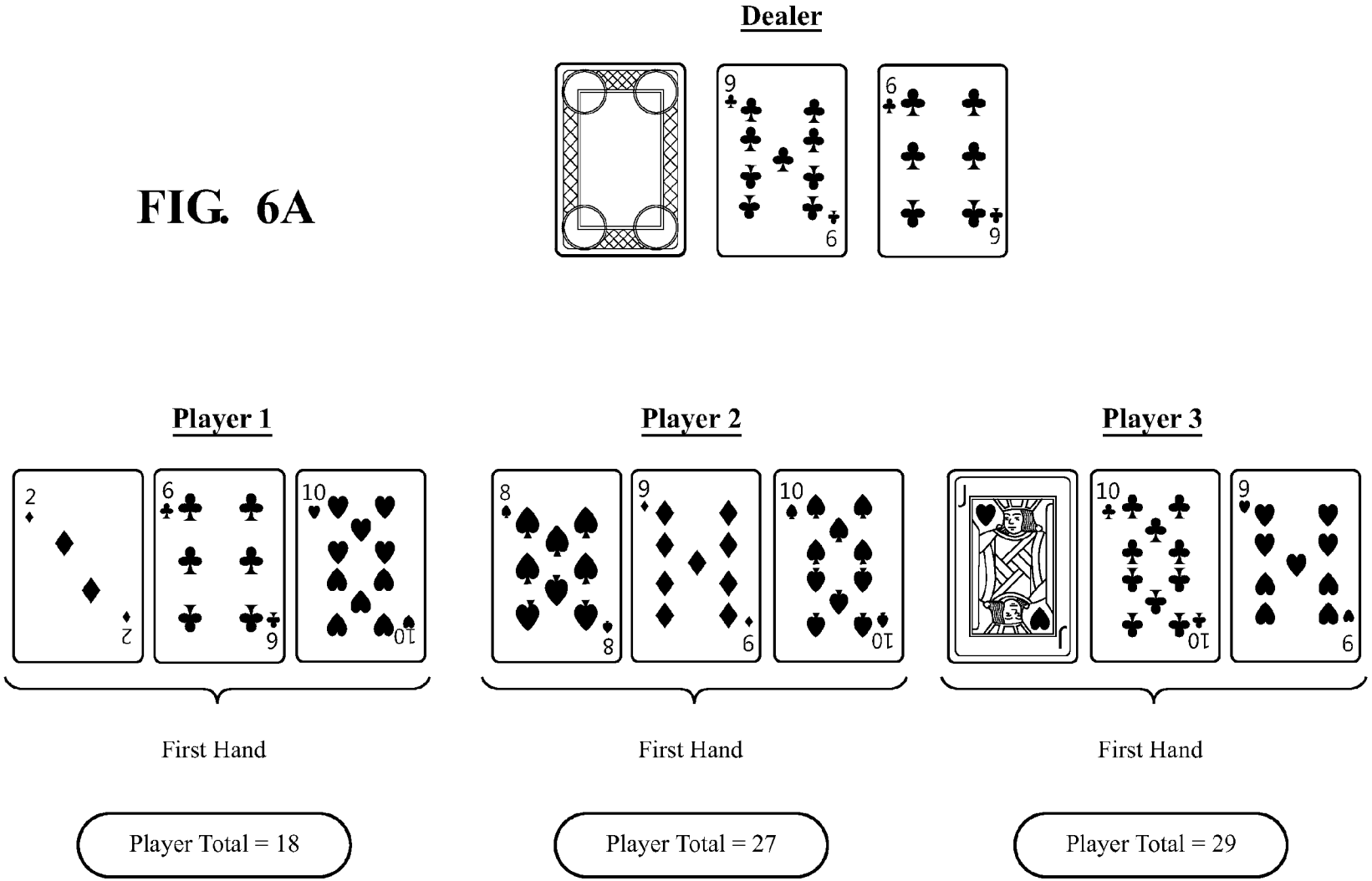
FIGS. 6A and 6B represent time sequence views of the same simplified playing surface wherein three players move progressively through rounds of play against a dealer.

FIG. 6A is an exemplary depiction of a round of the version of the modified game where both dealer and player start with 3 cards and try to reach, without exceeding, a total of 30. In this example the players each have been dealt their 3 cards. Player 1 has a 3 card total of 18, player 2 has a 3 card total of 27, and player 3 has a 3 card total of 29. The dealer has a 9 and 6 exposed for a total of 15.

Figure 6B:
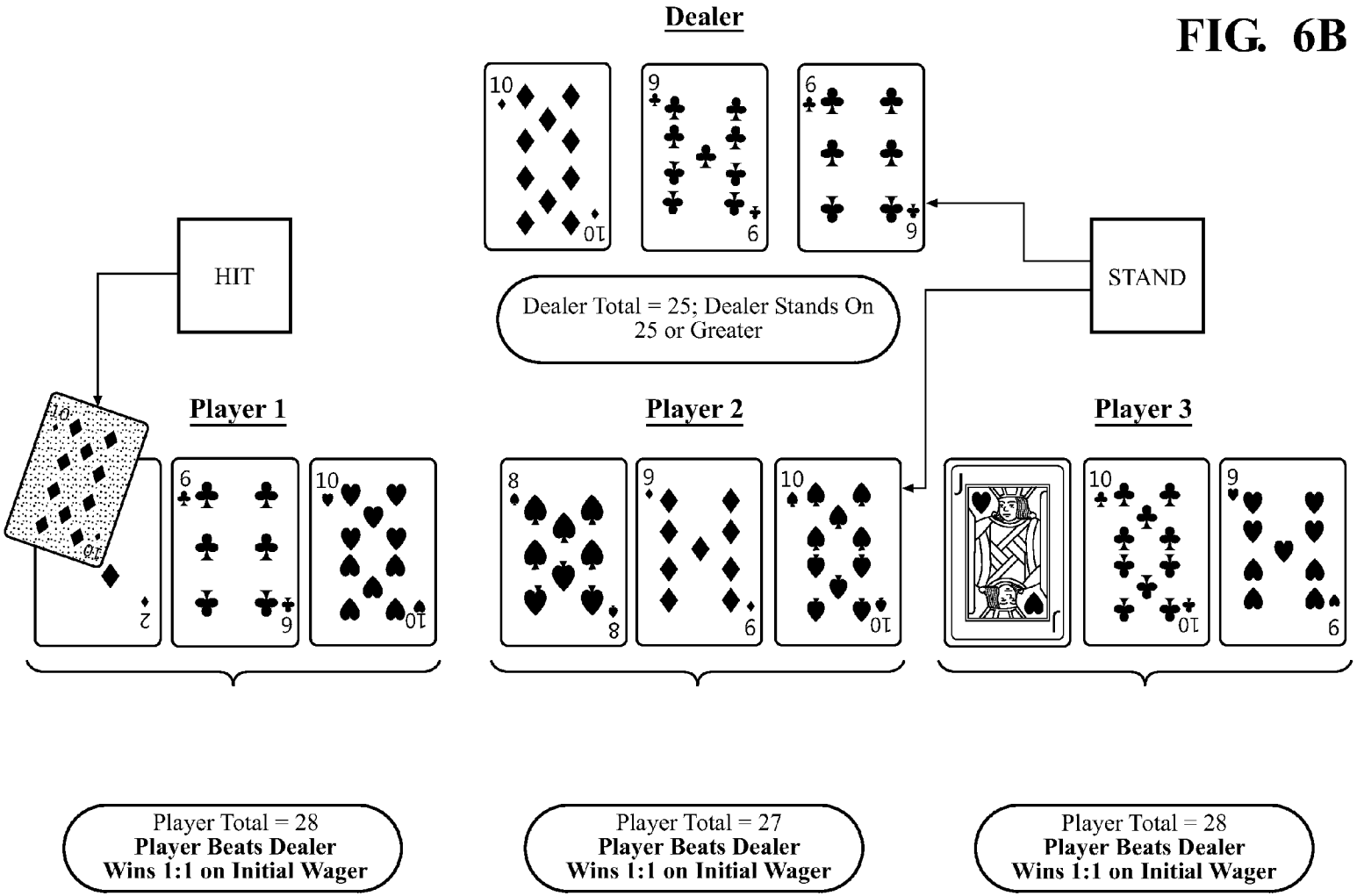

FIG. 6B is a continuation of the hand shown in FIG. 6A. Player 1 has decided to hit and received a 10 for a total of 28. Players 2 and 3 stood with their totals of 27 and 28 respectively. The dealer's unexposed card is then revealed which in this depiction is a 10, giving the dealer a total of 25. The dealer stands on all hands 25 or greater. Each player's hand total exceeds that of the dealer. Each player wins 1:1 on their original wager.

Figure 7A:
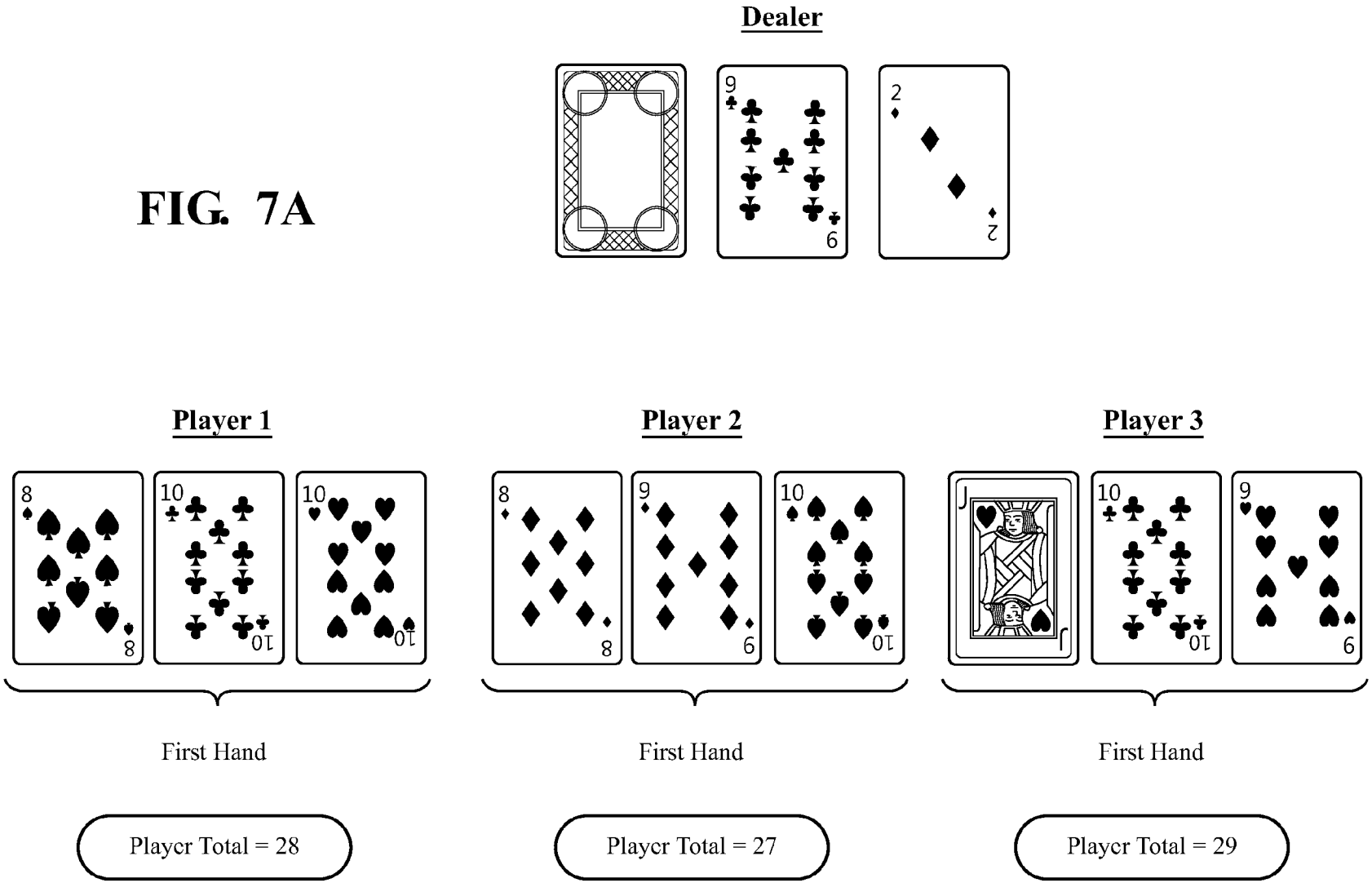
FIGS. 7A and 7B represent time sequence views of a game according to the modified variation wherein three players play against a dealer.

FIG. 7A is an exemplary depiction of a round of the version of the modified game where both dealer and player start with 3 cards and try to reach, without exceeding, a total of 30. In this example the players each have been dealt their 3 cards. Player 1 has a 3 card total of 28, player 2 has a 3 card total of 27, and player 3 has a 3 card total of 29. The dealer has a 9 and 2 exposed for a total of 11.

Figure 7B:
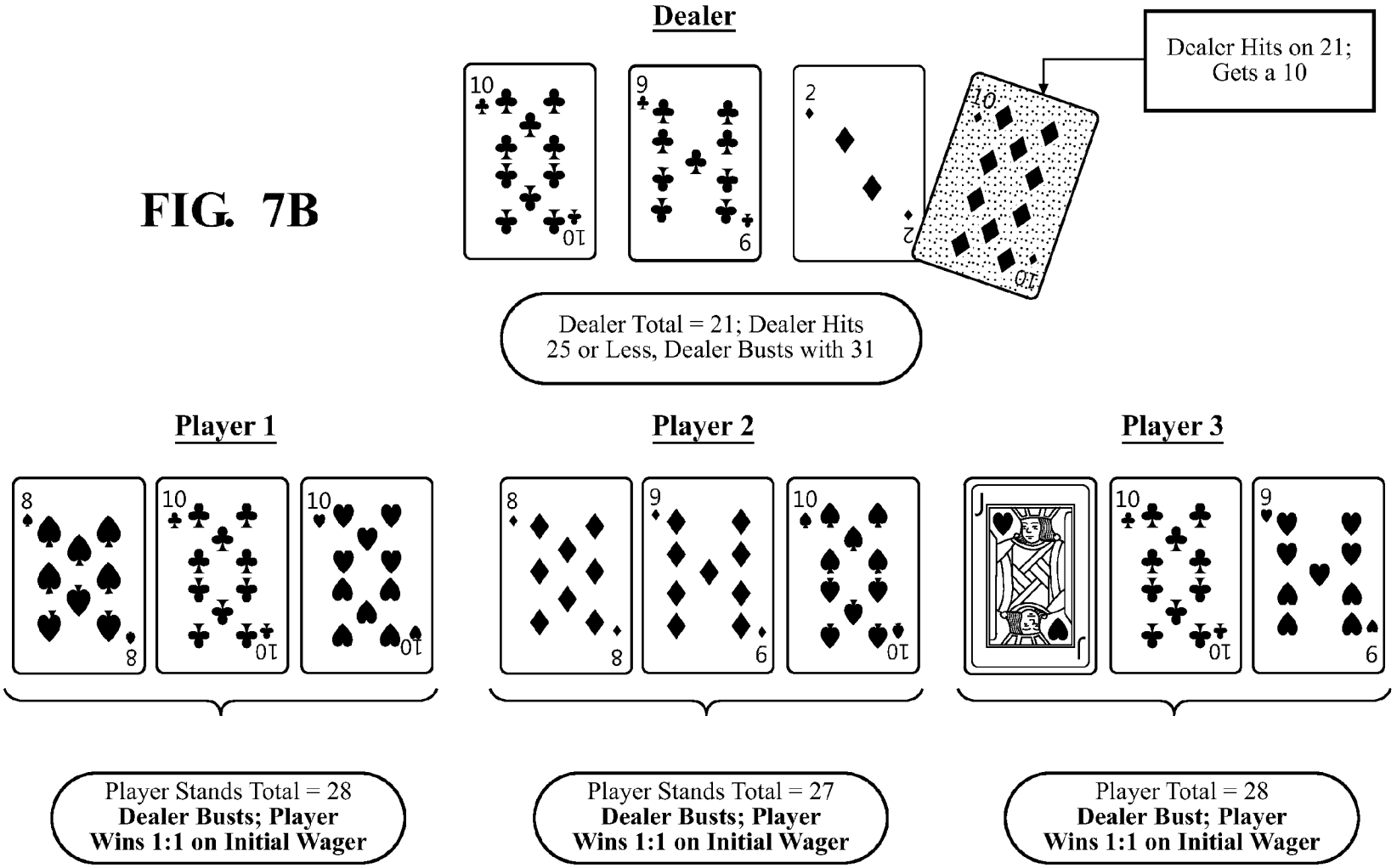

FIG. 7B is a continuation of the hand shown in FIG. 7A. All players opt to stand. The dealer exposes their down card which is a 10 for a total of 21. The dealer hits all hands of 24 or less and draws a 10 for a total of 31, which is a bust. All players who have not busted will win their wagers, thus players 1, 2, and 3 all win their original wager at a ratio of 1:1.

As is common with other card games, the various versions of blackjack games described above may be played between at least one player and an automated device. The automated device may be a computer or any other device, mobile or otherwise, capable of playing blackjack. The device may represent one or more additional players and a dealer. Such devices include a display; means of making selection, such as for example, a touch-screen display, a set of keys or a keyboard; means of collecting and dispensing actual or virtual wagers, for example, an opening for depositing and dispensing coins or tokens, or reading a magnetic card; and a data processing unit. Such a device may be programmed to offer side bets as a part of a blackjack game.

Alternatively, the live table version of the present invention (in any of its forms) may be implemented via a computer-assisted table manifested via a display screen and generating virtual markings in accordance with traditional rules of blackjack, and means for making selections. The automated device can further comprise a means for receiving and dispensing funds, such as a magnetic card reader as well as other functionality that may be useful and incorporated into a comprehensive gaming system.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A method of playing a wagering game, comprising:

providing an electronic gaming machine configured to display images of playing cards on a display screen;

providing a non-transitory computer readable medium coded with instructions and executed by a processor to perform the steps of:

providing the mathematical equivalent of at least one deck of 52 playing cards;

providing a graphical representation of a game playing surface on the display screen;

providing a graphical representation of a dealer location and at least one player location within the playing surface on the display screen;

receiving a first wager from a player;

dealing three cards from the deck to the player location to form an initial three-card hand, arranging all three cards of the initial three-card hand face up on the playing surface;

dealing two cards from the deck to the dealer location to form an initial dealer two-card hand, arranging one card from the initial two-card hand face up on the playing surface and the other card face down on the playing surface;

determining a total point value of the dealer's initial two card hand;

resolving the game in favor of the dealer when the total point value of the dealer's initial two-card hand is twenty-one;

when the total point value of the dealer's initial two-card hand is anything other than twenty-one, then inviting the player to choose a game hand;

after said inviting step, requiring the player choose between the steps of standing, hitting, doubling-down and surrendering each game hand as per the traditional rules of blackjack;

turning the face down card of the dealer's initial two-card hand to a face up position on the playing surface;

resolving each wager received from the player according to conventional rules of black jack;

determining a player's response to said inviting step;

when the player accepts the invitation of said inviting step, said inviting step includes player options of keeping the initial three-card hand as a single game hand and breaking down the initial three-card hand into multiple distinct game hands, wherein said step of breaking down the initial three-card hand includes player options selected from a plurality of player options including at least A) separating the initial three-card hand into two game hands comprised of one and two cards respectively, forfeiting the first wager, and receiving from the player a second wager and a third wager, and B) separating the initial three-card hand into three game hands comprised of one card respectively, retaining in play the first wager, and receiving from the player a second wager and a third wager;

and determining the player options that are selected by the player.

2. The method of claim 1, wherein said step of optionally separating the initial three-card hand into three game hands includes at least two of the three cards in the initial three-card hand having the same rank.

3. The method of claim 1, further including providing an initial three-card pay table having a plurality of predetermined three-card combinations with associated pay out rates, and prior to said inviting step resolving the first wager in favor of the player if the player's initial three-card hand matches one of the predetermined three-card combinations in the initial three-card pay table.

4. The method of claim 3, wherein the initial three-card pay table includes a pre-determined card sum of thirty.

5. The method of claim 3, wherein the initial three-card pay table includes a pre-determined card combination of two Queens and one Jack.

6. The method of claim 3, wherein the initial three-card pay table includes a pre-determined card combination of two Queens and one King.

* * * * *